United States Patent [19]

Booman et al.

[11] Patent Number: 4,868,380

[45] Date of Patent: Sep. 19, 1989

[54] OPTICAL WAVEGUIDE PHOTOCATHODE

[75] Inventors: Richard A. Booman; Stephen F. Blazo, both of Portland, Oreg.

[73] Assignee: Tektronix, Inc., Beaverton, Oreg.

[21] Appl. No.: 163,347

[22] Filed: Mar. 2, 1988

[51] Int. Cl.[4] ..... H01J 40/14

[52] U.S. Cl. ..... 250/211 R; 250/213 R

[58] Field of Search ..... 250/207, 211 R, 213 R, 250/227, 213 VT; 313/105 CM, 103 CM

[56] References Cited

U.S. PATENT DOCUMENTS

| | | | |
|---|---|---|---|
| 4,021,693 | 5/1977 | Bradley et al. | 250/213 VT |
| 4,177,487 | 12/1979 | Takenouchi et al. | 313/105 CM |
| 4,282,427 | 8/1981 | Brjukhnevich et al. | 250/213 VT |
| 4,327,285 | 4/1982 | Bradley | 250/213 VT |
| 4,712,001 | 12/1987 | d'Humieres et al. | 250/213 VT |
| 4,767,207 | 8/1988 | Takiguchi | 250/213 VT |

*Primary Examiner*—Davis L. Willis

*Assistant Examiner*—Stephone B. Allen

*Attorney, Agent, or Firm*—William A. Birdwell

[57] ABSTRACT

An optical waveguide photocathode for converting optical signals to electrical signals has an optical waveguide, a semiconductor covering the end of the optical waveguide, a first transparent electrode disposed between the end of the waveguide and the semiconductor, and a second electrode disposed adjacent to and spaced from the semiconductor. An electric potential is applied between the first electrode and the second electrode. The waveguide, first conductor, and semiconductor are relatively pointed at the end to produce high electric field strength at the semiconductor thereby enabling semiconductors with high work functions to be used. The relatively small area of the semiconductor illuminated by the waveguide reduces the dark current, making the device more sensitive to low level signals. The device may be used in a streak tube or a photomultiplier.

29 Claims, 3 Drawing Sheets

OPTICAL WAVEGUIDE PHOTOCATHODE

BACKGROUND OF THE INVENTION

This invention relates to an optical waveguide photocathode for converting optical signals to electrical signals.

Typically, optical signals are converted to electrical signals in a semiconductor photodiode or a vacuum photodiode. The semiconductor photodiode consists of a sandwich of planar layers of semiconductor material, across which layers a voltage differential is applied. Typically, the first layer is transparent to light to allow light to penetrate into the semiconductor layers where it is absorbed, thereby releasing current carriers which, as a result of the voltage differential, migrate through the layers and complete the circuit between the layers.

The vacuum photodiode consists of a semiconductor between two conductors. In a vacuum photodiode the first conductor is transparent to allow light to pass through to the semiconductor where it can be absorbed, thereby emitting electrons. The second conductor is separated from the semiconductor by a gap and the semiconductor and conductors are placed in a vacuum enclosure. A voltage differential is applied between the two conductors so that the electrons emitted from the semiconductor cross the gap to the second conductor. The semiconductor in a vacuum photodiode is commonly referred to as the photocathode.

The disadvantage of the semiconductor photodiode is that the carriers of current, for example electrons, are bound to the semiconductor and cannot be emitted into a vacuum for use in applications such as streak tubes and photomultipliers. A streak tube is a device for performing high speed analysis of signals. A photomultiplier is a device which increases the gain of the signal.

While the vacuum photodiode permits the emission of electrons into a vacuum for use with a streak tube or photomultiplier, the disadvantage of a typical vacuum photodiode is that it is relatively insensitive and inefficient. The insensitivity comes from the fact that these devices typically have a relatively large dark current. The dark current consists of those electrons released by the semiconductor in the absence of any optical signal source. The dark current is produced by thermal and quantum effects and is always present. For a given semiconductor material the amount of dark current is directly proportional to the size of the active area of the semiconductor. The active area is that part of the semiconductor upon which the optical signal shines and from which released electrons are collected by the conductors.

The relatively large dark current of the typical photocathode methods for converting optical signals to electrical signals masks the minute currents generated by very low level optical signals, thereby rendering such devices insensitive to such low level signals.

In addition to being insensitive to low level signals because of a relatively large dark current, the typical photocathode methods are relatively inefficient in converting optical signals into electrical signals because they must use only a very limited range of semiconductor materials. These materials are able to efficiently convert optical signals into electrical signals only within a very limited range of wavelengths of light. In the typical photocathode methods for converting optical signals to electrical signals, only those semiconductors having a relatively low work function can be used.

The work function is the energy required to free an electron bound to an atom of the semiconductor material and move it an infinite distance from that atom. As a practical matter this is the energy needed for the electron to migrate into the second conductor. A semiconductor with a low work function is required in present devices because the electrical fields which move the electrons through the semiconductor to the second conductor are relatively weak and such fields are not strong enough to move the electron through a semiconductor with a high work function.

The consequence of using such a limited range of semiconductor materials is that the semiconductor material cannot be selected for maximum efficiency in converting light into electrical signals. For example, the semiconductor typically used in photocathode devices is either silver cesium oxide or antimony cesium oxide, and the efficiency of these materials is such that at a wavelength of 1,300 nanometers only approximately one electron is released for every one million photons of incident light. Thus, 999,999 photons out of every 1 million photons of the optical signal are not detected and do not get converted into an electrical signal. Also, because of the limited number of semiconductor materials which will function in the low electric fields of such typical devices the semiconductor cannot be chosen to optimize its efficiency for a given wavelength of light.

Accordingly, there is a need for a more sensitive and efficient method of converting optical signals to electrical signals, particularly in streak tubes and photomultipliers.

SUMMARY OF THE INVENTION

The present invention solves the problem of the relatively inefficient and insensitive conversion of optical signals to electrical signals in typical photocathode devices by using an optical waveguide to channel the optical signal to a very small area of the semiconductor. The use of an optical waveguide to channel the optical signal to the semiconductor allows the use of a very small active area of the semiconductor as compared to the active area in previous devices. Since the dark current is proportional to the size of the active area of the semiconductor, the use of a very small active area results in a very small dark current and permits the analysis of much lower level signals than is possible with previous devices.

In addition to increasing the sensitivity by reducing the dark current, the present invention also allows for a much greater efficiency in converting optical signals to electrical signals by shaping the active area of the semiconductor into a pointed tip, that is, a tip which is curved or pointed. As a result of such a tip shape high electric fields are generated for any given voltage differential. The high electric field of the present invention allows the use of a wide range of semiconductor materials since the field is strong enough even to move electrons through semiconductors with high work functions. The invention therefore allows the selection of a variety of semiconductor materials so as to optimize the efficiency in converting incoming light of a given wavelength into electrical current.

Furthermore, these improvements in sensitivity and efficiency are accomplished by the present invention without sacrificing the ability to analyze optical signals whose amplitudes vary at a very high rate with respect t time.

One application of the present invention is to allow the analysis in a streak tube of weak optical signals whose amplitudes are varying at high rates with respect to time. In such a streak tube, the electrons emitted from the semiconductor as a result of the optical signal are deflected, or streaked, across a screen. In this way the changes in incoming signals over time can be spread out spatially for more detailed analysis. In such a streak tube, the degree of spatial displacement per unit time can be varied according to the needs of the analysis merely by varying the rate of deflection of the electrons which are emitted from the semiconductor into the vacuum.

Therefore, it is a principal objective of the present invention to provide an improved device and method for the conversion of optical signals to electrical signals.

It is a further objective of the present invention to provide a more efficient and sensitive device and method for the analysis of low level optical signals It is a further objective of the present invention to provide a device and method for optimizing the conversion of optical signals to electrical signals for a given wavelength of light.

It is another objective of the present invention to provide a vacuum photodiode device and method that exhibits reduced dark current.

It is yet another objective of the present invention to provide a vacuum photodiode device and method that permits the efficient use of semiconductor photocathodes having relatively high work functions.

These and other objectives, features and advantages of the invention will be more readily understood upon consideration of the following detailed description of the invention, taken in conjunction with the accompanying drawings.

DESCRIPTION OF THE PREFERRED EMBODIMENT

Figure 1:
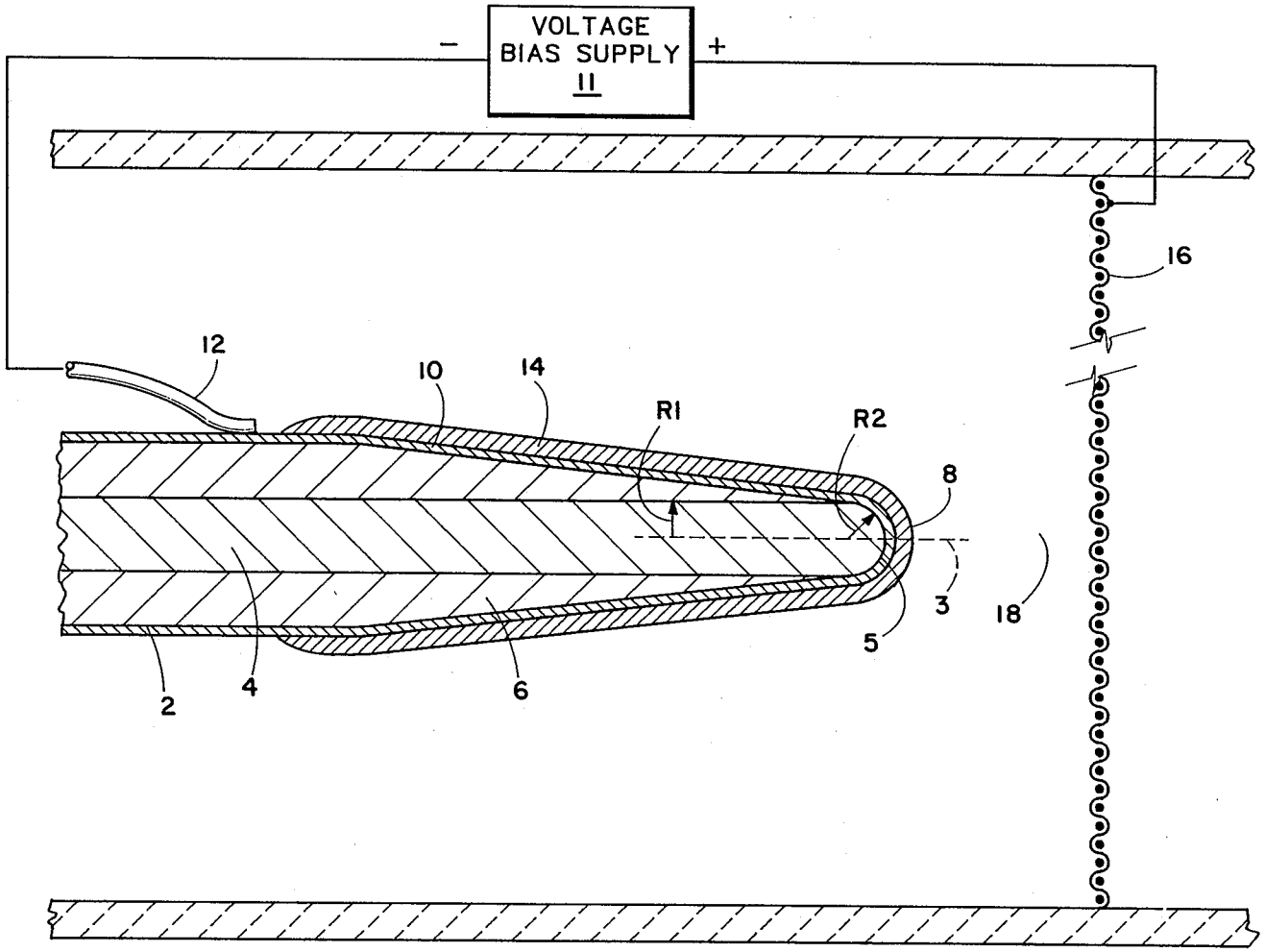
FIG. 1 shows a preferred embodiment of an optical waveguide photocathode according to the present invention.

Referring to FIG. 1, according to the present invention, an optical fiber 2 is used in the preferred embodiment as the waveguide to direct the light signal to the semiconductor. One end of the optical fiber 2, preferably comprising a cylindrical core 4 having a cylindrical radius R1 and surrounded by cladding 6, is formed into a point. The pointed end of the optical fiber is centered substantially at the axial center 3 of the core 4. The surface 5 of the pointed end is rounded and the radius R2 of such surface is on the order of the cylindrical radius R1 of the core 4. Because the cylindrical radius of the core is so small, approximately 4 to 5 microns, the surface is very sharply curved in relation to the size of the device as a whole. The sharply curved surface at the pointed end can be formed by etching, grinding, or drawing one end of the optical fiber 2.

The pointed end of the optical fiber 2 is then coated with a thin layer of transparent conductor material 10. The transparent conductor 10 is then connected at a location away from the tip to a voltage bias supply 11. This connection may be by a wire 12 as indicated in FIG. 1, or by any other convenient conducting material. A thin layer of semiconductor 14 covers the transparent conductor 10 forming a tip 8 over the transparent conductor and over the surface of the pointed end of the optical fiber 2. The tip 8 takes the shape of the surface of the pointed end of the optical fiber and therefore is also sharply curved and has a very small radius on the order of the cylindrical radius of the core 4. The conductor 10 and semiconductor 14 form a photocathode.

In this arrangement, the entire optical signal is channeled by the fiber core 4 through the transparent conductor and strikes the semiconductor 14 only at the tip 8. The active area of the semiconductor therefore is very small, being that part of the semiconductor directly in front of the fiber core 4. Because the active area is so small, the dark current is also very small. The very small dark current makes the present invention very sensitive to low level optical signals since such signals are not swamped by a large dark current.

When used in conjunction with a relatively large, planar anode, the very sharp curve of the tip 8 has the effect of creating a very high electric field strength near the photocathode for a given voltage as compared to the planar surfaces of semiconductor cathodes typically used to convert optical signals to electrical signals. While the preferred embodiment of the present invention contemplates a smoothly curved, rounded tip, other tip shapes which have the effect of creating enhanced electric field strength for a given voltage as compared to a planar surface may be used according to the present invention.

The thickness of the semiconductor 14 should be sufficient so that most of the light emitted by the core 4 is absorbed by the semiconductor 14 to assure that the optical signal is converted to an electrical signal A practical thickness for the semiconductor material is on the order of 1 to 2 microns.

However, the thicker the layer of semiconductor the narrower the bandwidth of the optical fiber photocathode. The thickness of the semiconductor, therefore, places an upper limit on the ability of the photocathode to resolve an optical signal whose amplitude is rapidly changing. This is because the migration time of electrons released by an optical signal increases as the thickness of the semiconductor increases. As this migration time approaches the frequency of the changes in the input optical signal, the level of electron emissions from the semiconductor becomes less responsive to changes in the amplitude of the input optical signal and the ability to resolve changes in such signal diminishes. Thus, if very rapid changes in optical signals are to be resolved, then, according to the present invention, it is contemplated that the layer of semiconductor 14 should be reduced in thickness. Any such reduction should be sufficient enough to shorten the migration time to allow resolution of the changes in the amplitude of optical signals being input, even though this will reduce the amount of light converted to electron emissions.

While various types of semiconductors may be used in the present invention, the preferred embodiment contemplates that the composition of the semiconductor 14 be varied according to the wavelength of the input optical signal in order to maximize the probability that a photon from the optical signal will be absorbed and result in an electron being emitted. In this way the efficiency of the conversion from optical to electrical signals is optimized. For example, if the wavelength of the input optical signal is on the order of 400 to 1,000 nanometers, silicon is the preferred semiconductor. Gallium arsenide is the preferred semiconductor for wavelengths between 800 and 1,000 nanometers. Germanium becomes the preferred semiconductor as the wavelength of the input optical signal is in the range of 900 to 1,500 nanometers. Between approximately 1,200 to 1,700 nanometers the preferred semiconductor material is indium gallium arsenide.

These and other semiconductor materials can be used according to the present invention because of the high electric field strength resulting from the sharply curved tip 8. This high electric field strength allows the use of a variety of semiconductors, which cannot be used in typical photocathode devices simply because the low fields in such devices require the use of semiconductors which have a work function sufficiently low to allow the relatively weak electric fields to move the electrons emitted by the optical signal.

In the preferred embodiment, an anode connected to the bias voltage supply 11 is provided by a mesh electrode 16 which is located in front of the tip 8 and separated from the tip by a gap 18. The tip 8 and the mesh electrode 16 are maintained in a vacuum environment. The electric field in the tip 8 is created by the voltage differential between the transparent conductor 10 and the mesh electrode 16. It is this electric field which moves the electrons through the semiconductor 14 and causes them to be emitted into the gap 18 and accelerated toward the mesh electrode 16. The mesh electrode is used in the preferred embodiment because it allows the electrons to pass through it for further analysis. Other electrodes and electrodes of different shapes could be used without departing from the present invention as long as the necessary electric field is created so that electrons will migrate through the semiconductor 14 and be emitted from the tip 8.

When an optical signal is emitted from the core 4, the light passes through the transparent conductor 10 and is absorbed by the semiconductor 14. Upon such absorption by the semiconductor 14, the semiconductor releases electrons which migrate to the tip 8 where they are emitted and accelerated across the gap 18 toward the mesh electrode 16. Many of the electrons will travel through the openings of the mesh electrode and continue onward where they may be analyzed by a variety of means used for analyzing electron beams in a vacuum such as, for example, a streak tube where the electrons are swept across a phosphor screen.

Figure 2:
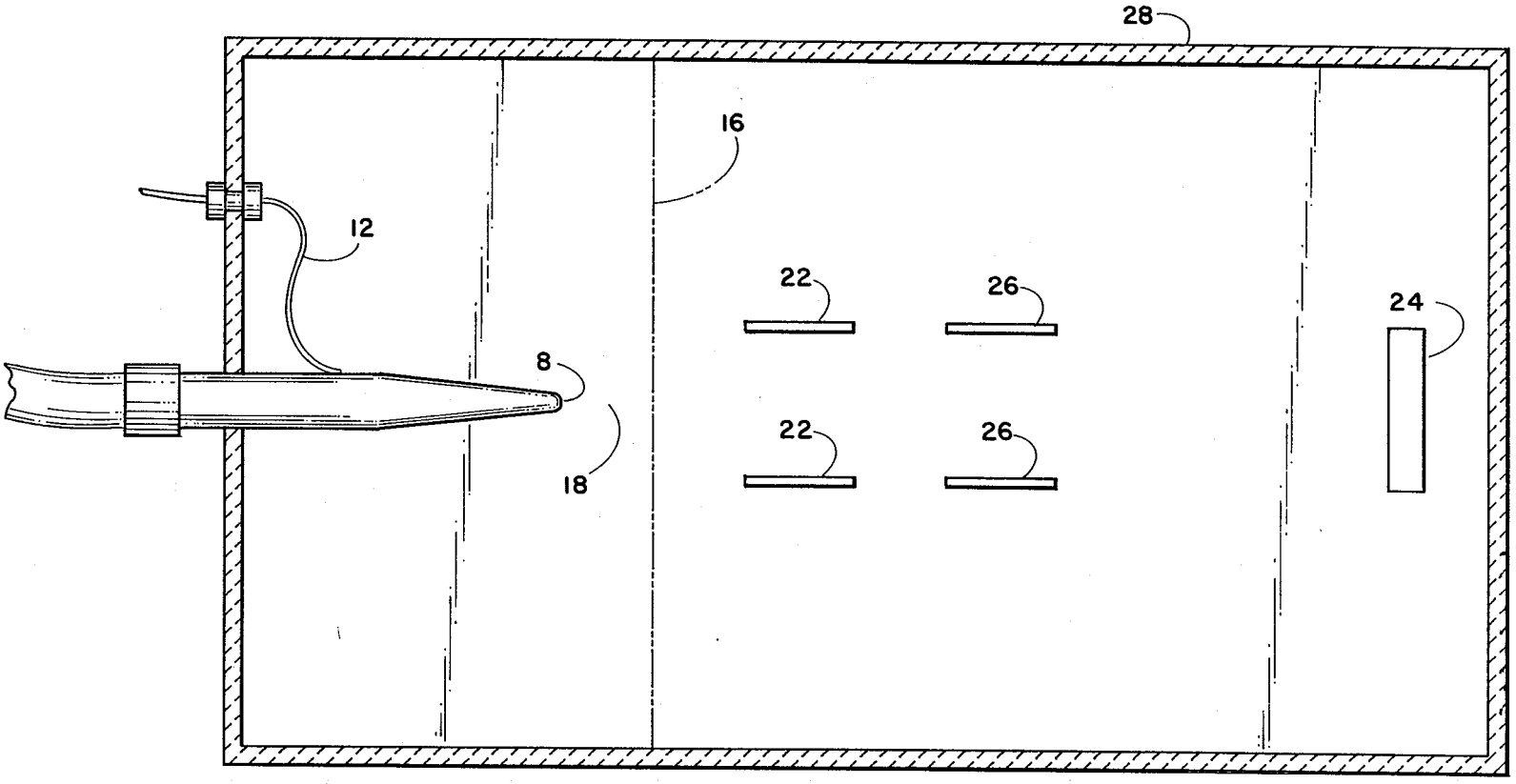
FIG. 2 shows an application of the present invention in a streak tube.

FIG. 2 shows an application of the present invention in a streak tube. Electrons emitted from the tip 8, which is shown in greater detail in FIG. 1, are accelerated across the gap 18 by the mesh electrode 16. Electrons passing through the mesh electrode 16 are then focused into a beam by focusing electrodes 22. The beam is then swept across a target 24 by deflection plates 26. The tip 8, mesh electrode 16, focusing electrodes 22, deflection plates 26, and target 24 are all contained within a vacuum enclosure 28. By sweeping the beam of electrons a predetermined distance in a given time, variations in the signal over time can be spread out over the target 24 for detailed analysis.

Figure 3A:
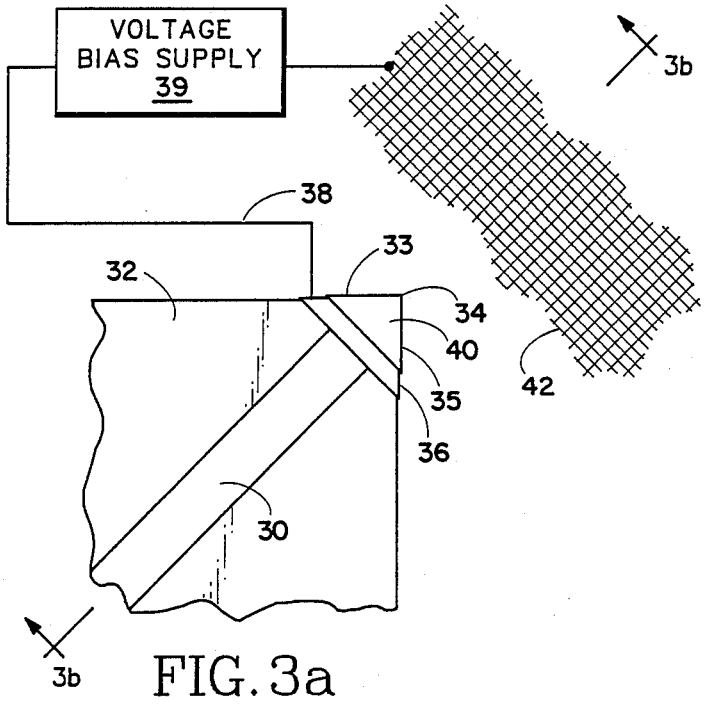
FIG. 3*a* shows a top view of an alternative embodiment of an optical waveguide photocathode according to the present invention.
Figure 3B:
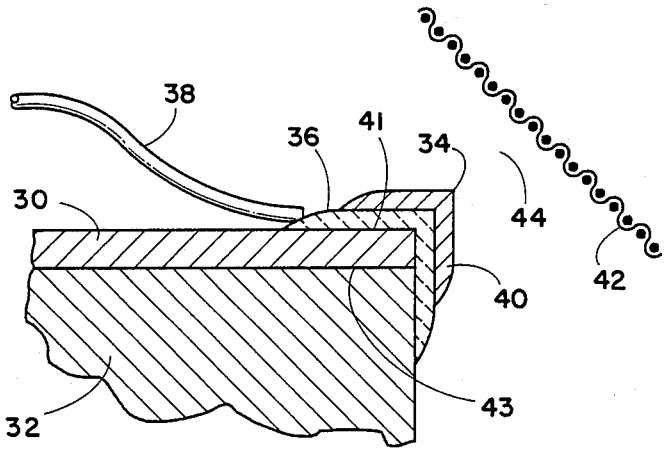
FIG. 3*b* shows a cross sectional view of the embodiment of an optical waveguide photocathode shown in FIG. 3*a*, taken along line 3*b*–3*b* thereof.

FIGS. 3*a* and 3*b* show an alternative embodiment of an optical waveguide photocathode according to the present invention which uses another type of optical waveguide to channel the optical signals to a small active area on the semiconductor material.

FIG. 3*a* shows a top view of a typical waveguide of this nature. The waveguide 30 is formed on top of a substrate 32. Typically, the substrate 32 is made of sapphire. The waveguide material may be zinc oxide or lithium niabate, or any of several other materials depending on the wavelength of light to be transmitted along the waveguide. In this embodiment of the present invention, the waveguide would channel the light signal to a corner 34 of the substrate. At the corner, the waveguide forms a substantially V-shaped end having sides 33 and 35 corresponding to the sides of the V and top and bottom sides 41 and 43.

FIG. 3*b* shows a longitudinal cross section of the waveguide showing the substrate 32 and the waveguide material 30. The lateral cross section is substantially rectangular in shape. Some waveguides may have an additional layer on top of the waveguide layer 30, depending on the optical characteristics of the waveguide material and the wavelength of the light transmitted along the waveguide. At the corner 34 of the waveguide a thin film of transparent conducting material is deposited. The resulting transparent conductor 36 is connected at a location away from this corner 34 to a voltage bias supply 39. This connection may be by a wire 38 or by any other convenient conducting material. A thin layer of semiconductor 40 covers the transparent conductor 36 at the corner so that the end of the waveguide 30 is completely covered. The semiconductor 40 assumes the shape of the corner of the waveguide 30, which is a sharp point, and as in the previous embodiment shown in FIG. 1 results in a high electric field for a given voltage when an electrode which is connected to the bias voltage supply is located in front of the corner 34. The electrode 42 is separated from the corner by a gap 44. In this embodiment of the invention the corner shape creating a sharp point is used primarily due to ease of fabrication. However, the invention contemplates the use of other tip shapes instead of the corner shape 34 where such other tip shapes create a high electric field strength at the photocathode for a given bias voltage.

The terms and expressions which have been employed in the foregoing specification are used therein as terms of description and not of limitation. There is no intention in the use of such terms and expressions of excluding equivalents of the features shown and described or portions thereof, it being recognized that the scope of the invention is defined and limited only by the claims which follow.

What is claimed is:

1. A device for converting optical signals to electrical signals, said device comprising:

(a) an optical waveguide for conducting said optical signals, said waveguide having an end for emitting said signals;

(b) a semiconductor disposed at said end of said optical waveguide;

(c) first electrode means for connecting said semiconductor to an electric circuit; and (d) second electrode means spaced from said semiconductor for connection to said electric circuit to produce an electric potential difference between said semiconductor and said second electrode means and thereby attract toward said second electrode means electrons emitted from said semiconductor.

2. The device of claim 1, wherein said waveguide, said semiconductor, and said electrode means are disposed in a substantially evacuated environment.

3. The device of claim 1 wherein said first electrode means comprises a transparent conductor disposed between said end of said optical waveguide and said semiconductor.

4. The device of claim 1 wherein said waveguide is an optical fiber, said end thereof is relatively pointed and directed toward said second electrode means, and said semiconductor comprises a layer of semiconductor material covering said pointed end thereby forming a pointed tip directed toward said second electrode means.

5. The device of claim 1 wherein said optical waveguide comprises an optically conductive material disposed on a substrate.

6. The device of claim 1, wherein said second electrode is a mesh electrode.

7. The device of claim 1, wherein said semiconductor has a pointed tip directed toward said second electrode means.

8. The device of claim 3 further comprising means for connecting said transparent conductor to said electric circuit.

9. The device of claim 4 wherein said optical fiber has a core which is substantially cylindrical in shape and said end is substantially hemispherical in shape and has a radius approximately equal to the cylindrical radius of said core.

10. The device of claim 5 wherein said end of said optical waveguide is substantially V-shaped, said semiconductor being disposed over one point produced by a side of said waveguide and each side of the V so as to form a pointed tip directed toward said second electrode.

11. The device of claim 6 further comprising target means spaced beyond said second electrode means from said semiconductor for receiving electrons which pass through said second electrode means.

12. The device of claim 11 further comprising means for deflecting electrons laterally as they travel from said second electrode means toward said target means.

13. The device of claim 7 wherein said optical waveguide comprises an optical fiber.

14. The device of claim 7 wherein said second electrode means is substantially planar in shape and the maximum lateral dimension of said optical waveguide is much less than the maximum lateral dimension of said second electrode means.

15. The device of claim 7, wherein said semiconductor comprises silicon.

16. The device of claim 7, wherein said semiconductor comprises germanium.

17. The device of claim 7, wherein said semiconductor comprises gallium arsenide.

18. The device of claim 7 wherein said semiconductor comprises indium gallium arsenide.

19. The device of claim 7 further comprising electric circuit means connected to said first electrode means and said second electrode means for producing a positive electric potential at said second electrode means with respect to said first electrode.

20. A method for converting optical signals to electrical signals, said method comprising:

(a) placing a semiconductor adjacent one end of an optical waveguide so that light emitted by said end of said waveguide illuminates said semiconductor;

(b) placing an electrode adjacent to and spaced from said semiconductor; and (c) applying an electric potential between said electrode and said semiconductor.

21. The method of claim 20, further comprising applying said electric potential so as to produce a positive potential on said electrode with respect to said semiconductor.

22. The method of claim 20, further comprising placing said waveguide, said semiconductor, and said electrode in a substantially evacuated environment.

23. The method of claim 20, wherein said semiconductor has a pointed tip directed toward said electrode.

24. The method of claim 23 further comprising placing a transparent conductor between said end of said optical waveguide and said semiconductor.

25. The method of claim 24, wherein said optical waveguide is an optical fiber.

26. The method of claim 24, wherein said semiconductor comprises silicon.

27. The method of claim 24, wherein said semiconductor comprises germanium.

28. The method of claim 24, wherein said semiconductor comprises gallium arsenide.

29. The method of claim 24, wherein said semiconductor comprises indium gallium arsenide.

* * * * *